US006698235B2

(12) United States Patent
Nobuta et al.

(10) Patent No.: US 6,698,235 B2
(45) Date of Patent: Mar. 2, 2004

(54) REFRIGERANT CYCLE SYSTEM HAVING DISCHARGE FUNCTION OF GAS REFRIGERANT IN RECEIVER

(75) Inventors: Tetsuji Nobuta, Kariya (JP); Ryouichi Sanada, Obu (JP); Satoshi Sumiya, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/237,109

(22) Filed: Sep. 9, 2002

(65) Prior Publication Data

US 2003/0051503 A1 Mar. 20, 2003

(30) Foreign Application Priority Data

Sep. 18, 2001 (JP) ..... 2001-283608

(51) Int. Cl.[7] ..... F25B 39/04; F25B 1/00

(52) U.S. Cl. ..... 62/509; 62/498; 62/507; 62/503; 62/512; 62/474; 62/132; 62/173

(58) Field of Search ..... 62/509, 498, 507, 62/503, 512, 474; 165/132, 173

(56) References Cited

U.S. PATENT DOCUMENTS 6,000,465 A * 12/1999 Kawahara ..... 165/132
6,223,556 B1 * 5/2001 De Keuster et al. ..... 62/509
6,374,632 B1 * 4/2002 Nobuta et al. ..... 62/509
6,410,945 B1 8/2002 Haussmann
6,470,704 B2 * 10/2002 Shibata et al. ..... 62/509
6,477,858 B2 * 11/2002 Nobuta et al. ..... 62/509
6,494,059 B2 * 12/2002 Yamazaki et al. ..... 62/509
6,516,628 B2 * 2/2003 Izawa et al. ..... 62/509

FOREIGN PATENT DOCUMENTS

| | | |
|---|---|---|
| EP | 1 006 323 | 7/2000 |
| FR | 2 753 782 | 3/1998 |
| FR | 2 802 291 | 6/2001 |
| JP | 2001-12823 | 1/2001 |

OTHER PUBLICATIONS

French Search Report.

* cited by examiner

*Primary Examiner*—William C. Doerrler
*Assistant Examiner*—Mark Shulman
(74) *Attorney, Agent, or Firm*—Harness, Dickey & Pierce, PLC

(57) ABSTRACT

A refrigerant cycle system includes a condenser having a condensation portion for condensing refrigerant discharged from a compressor, and a receiver for separating refrigerant from the condensation portion into gas refrigerant and liquid refrigerant, and for storing the liquid refrigerant. In this system, refrigerant from the condensation portion flows into the receiver through a first communication hole, and liquid refrigerant in the receiver is discharged through a second communication hole in which a pressure loss is generated. Further, gas refrigerant at an upper side in the receiver is discharged to a downstream side of the second communication hole through a gas bypass pipe.

20 Claims, 10 Drawing Sheets

REFRIGERANT CYCLE SYSTEM HAVING DISCHARGE FUNCTION OF GAS REFRIGERANT IN RECEIVER

CROSS REFERENCE TO RELATED APPLICATION

This application is based on Japanese Patent Application No. 2001-283608 filed on Sep. 18, 2001, the disclosure of which is incorporated herein by reference.

BACKGROUND OF THE INVENTION

1. Field of the Invention

The present invention generally relates to a refrigerant cycle system with an improved refrigerant-sealing performance. More particularly, the present invention relates to a discharge structure of gas refrigerant in a receiver of the refrigerant cycle system, which separates refrigerant from a refrigerant condenser into gas refrigerant and liquid refrigerant, and stores the liquid refrigerant therein. The present invention is suitably applied to a vehicle air conditioner.

2. Description of Related Art

In a conventional refrigerant cycle for a vehicle air conditioner, when heat from an engine compartment is transmitted to a receiver, liquid refrigerant stored within the receiver is boiled, and gas pressure within the receiver is increased. Therefore, a liquid refrigerant surface in the receiver becomes lower, and liquid refrigerant is discharged from the receiver to a downstream side. Accordingly, the liquid refrigerant stays in a condenser, high-pressure side refrigerant pressure is increased in the refrigerant cycle, and power consumed in a compressor is increased.

To overcome this problem, U.S. Pat. No. 6,374,632 proposes a refrigerant cycle system in which liquid refrigerant from a condenser flows into a receiver from upper and lower sides in the receiver. That is, in this refrigerant cycle system, an upper space of the receiver is cooled by latent heat of liquid refrigerant flowing from the upper side. However, a desiccant for adsorbing water contained in refrigerant is generally disposed within the receiver, and the refrigerant flow from the upper side in the receiver is restricted by the desiccant. As a result, the upper space of the receiver may not be sufficiently cooled using the liquid refrigerant introduced from the upper side.

SUMMARY OF THE INVENTION

In view of the foregoing problems, it is an object of the present invention to improve refrigerant sealing performance in a refrigerant cycle system.

It is an another object of the present invention to provide a refrigerant cycle system with a receiver, which prevents an increase of a gas pressure in the receiver even when the heat is transmitted into the receiver from an outside.

According to the present invention, a refrigerant cycle system includes a first refrigerant passage through which refrigerant after passing through a condensation portion of a condenser flows into a receiver, a second refrigerant passage through which liquid refrigerant stored at a lower side in the receiver flows outside the receiver, and a third refrigerant passage having two end portions with a predetermined pressure difference, through which gas refrigerant staying at an upper side in the receiver is discharged to a downstream side of the receiver. Accordingly, even when heat is transmitted into the receiver from an outside and liquid refrigerant in the receiver is boiled, because gas refrigerant at the upper side in the receiver is discharged outside the receiver through the third refrigerant passage, it can restrict the gas pressure in the receiver from being increased. As a result, it can prevent a liquid refrigerant surface in the receiver from being lowered due to an increase of the gas pressure in the receiver. That is, it can prevent refrigerant from over-flowing from the receiver toward the condenser. Therefore, refrigerant-sealing performance in the refrigerant cycle system can be improved, and COP of the refrigerant cycle system can be improved.

Preferably, the condenser includes a core portion at least including the condensation portion, and a header tank extending in the up-down direction to communicate with tubes of the core portion. Further, the receiver is integrated with the header tank, and each of the first and second refrigerant passages is a communication hole penetrating through the header tank and the receiver. Accordingly, the present invention can be effectively used for a refrigerant cycle system having a receiver-integrated condenser. In this case, the first refrigerant passage and the second refrigerant passage can be readily provided.

Preferably, the third refrigerant passage can be defined by a gas bypass pipe connected to the receiver from an outside of the receiver. Alternatively, a connection plate member can be inserted between the header tank and the receiver, and the third refrigerant passage is provided in the connection plate member. Alternatively, the third refrigerant passage can be provided in an approximately cylindrical body portion of the receiver while the body portion is integrally formed by punching or drawing. Accordingly, third refrigerant passage can be readily formed, and the gas refrigerant at the upper side in the receiver can be readily discharged.

Preferably, the second refrigerant passage is provided to generate a pressure loss therein, the third refrigerant passage has an outlet from which the gas refrigerant introduced in the third refrigerant passage from the upper side in the receiver is discharged, and the outlet of the third refrigerant passage is provided in the second refrigerant passage or at a downstream side of the second refrigerant passage. In this case, the third refrigerant passage readily has the predetermined pressure difference at the two end portions, and the gas refrigerant in the receiver can be effectively discharged.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

Figure 1:
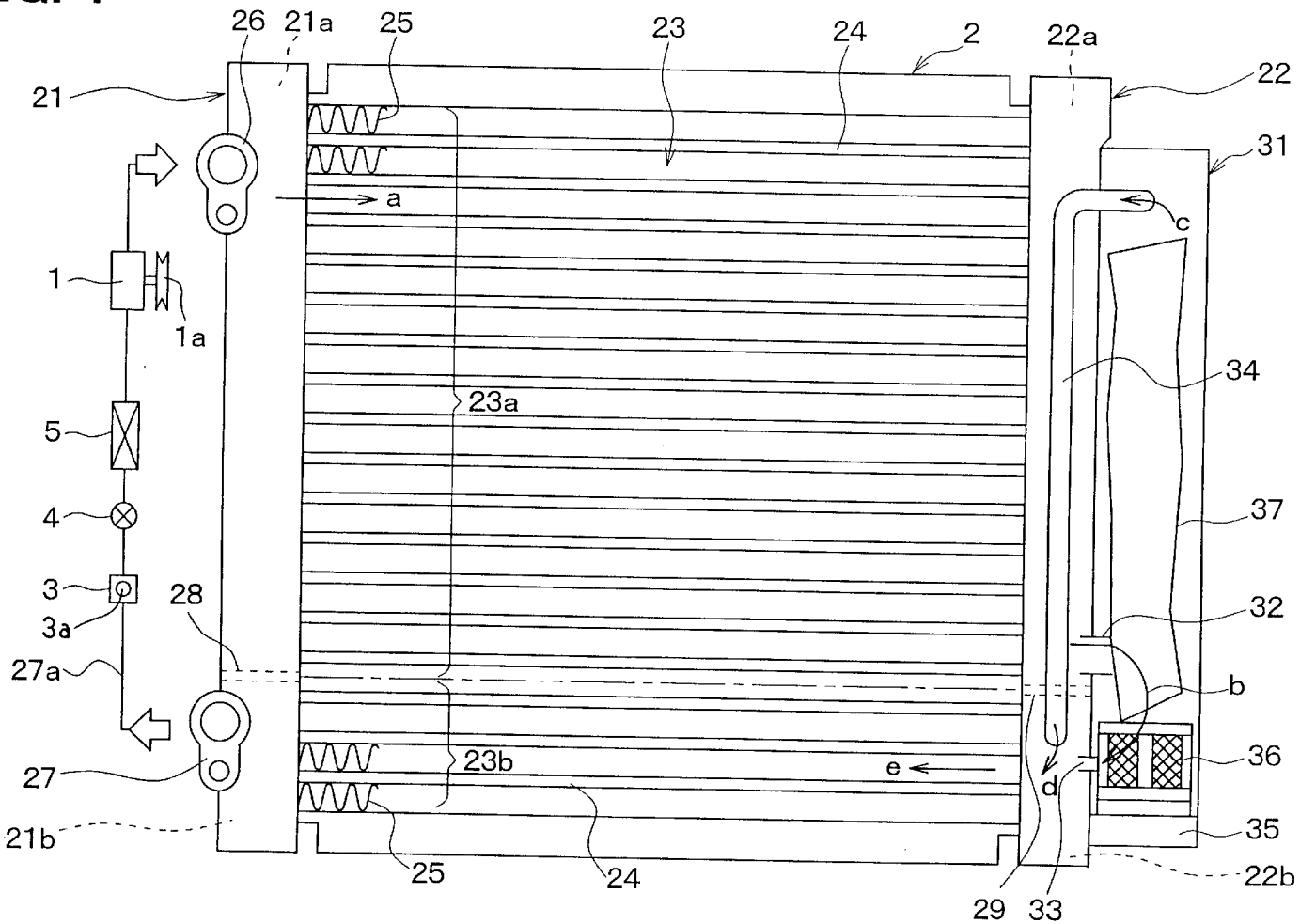
FIG. 1 is a partially-sectional schematic diagram showing a refrigerant cycle system according to a first preferred embodiment of the present invention.

A first preferred embodiment of the present invention will be now described with reference to FIGS. 1–4. In the first embodiment, the present invention is typically applied to a refrigerant cycle system for a vehicle air conditioner. As shown in FIG. 1, the refrigerant cycle system of the vehicle air conditioner includes a refrigerant compressor 1, a receiver-integrated refrigerant condenser 2, a sight glass 3, an expansion valve 4, and a refrigerant evaporator 5. All the components of the refrigerant cycle system are serially connected by a metal pipe or a rubber pipe to form a closed circuit.

The compressor 1 is connected to an engine disposed within an engine compartment through a belt and an electromagnetic clutch 1*a*. When the rotation power of the engine is transmitted to the compressor 1 through the electromagnetic clutch 1*a*, the compressor 1 compresses gas refrigerant sucked therein from the evaporator 5 and then discharges high-pressure high-temperature gas refrigerant toward an inlet joint 26 of the receiver-integrated refrigerant condenser 2.

The sight glass 3 is connected to a downstream refrigerant side of an outlet joint 27 of the receiver-integrated refrigerant condenser 2. The sight glass 3 is used as a refrigerant amount monitoring unit for monitoring the amount of refrigerant sealed in the refrigerant cycle system to check for the over or short supply by observing gas-liquid state. The sight glass 3 has a peephole 3*a* air-tightly sealed by a melted glass. When bubbles are found from the peephole 3*a*, it is determined that the amount of refrigerant is short-supplied. On the other hand, when bubbles are not founded, it is determined that refrigerant is properly supplied.

Refrigerant from the receiver-integrated refrigerant condenser 2 is decompressed in the expansion valve 4, so that low-temperature low-pressure refrigerant can be obtained. The evaporator 5 is a cooling unit for cooling air blown into a passenger compartment. That is, in the evaporator 5, refrigerant from the expansion valve 4 is evaporated by absorbing heat from air, so that air passing through the evaporator 5 is cooled.

Next, the structure of the receiver-integrated refrigerant condenser 2 will be now described. The receiver-integrated refrigerant condenser 2 includes a pair of first and second header tanks 21, 22 each of which extends in an up-down direction (i.e., vertical direction) and is formed into approximately cylindrically. A core portion 23 is disposed between the first and second header tanks 21, 22.

The core portion 23 includes plural flat tubes 24 through which refrigerant flows horizontally between the first and second header tanks 21, 22, and plural corrugated fins 25 each of which is disposed between adjacent flat tubes 24. Each one side end of the flat tubes 24 communicates with the first header tank 21, and each the other side end of the flat tubes 24 communicates with the second header tank 22. The inlet joint 26 is connected to the first header tank 21 at an upper side, and the outlet joint 27 is connected to the first header tank 21 at a lower side.

In the first embodiment, a first separator 28 is disposed within the first header tank 21 at a lower side position, and a second separator 29 is disposed within the second header tank 22 at the same height position as the first separator 28. Thus, an inner space of the first header tank 21 is partitioned into upper and lower spaces 21*a*, 21*b* in the up-down direction by the first separator 28, and an inner space of the second header tank 22 is also partitioned into upper and lower spaces 22*a*, 22*b* in the up-down direction by the second separators 29. Accordingly, refrigerant introduced into the upper space 21*a* of the first header tank 21 from the inlet joint 26 passes through the flat tubes 24 as shown by the arrow "a" in FIG. 1, and flows into the upper space 22*a* of the second header tank 22.

A condensation portion 23*a* is constructed by an upper portion in the core portion 23 of the receiver-integrated refrigerant condenser 2, positioned upper than the first and second separators 28, 29. In the condensation portion 23*a* of the core portion 23, air blown by a cooling fan (not shown) is heat-exchanged with refrigerant flowing through the flat tubes 24 to cool the refrigerant.

A receiving unit 31 is formed integrally with the second header tank 22 in the receiver-integrated refrigerant condenser 2. Gas refrigerant and liquid refrigerant are separated in the receiving unit 31, and liquid refrigerant is stored in the receiving unit 31. The receiving unit 31 is formed into an approximate cylindrical shape, and is connected to an outer surface of the second header tank 22 at a side opposite to the core portion 23. The receiving unit 31 has a height slightly lower than that of the second header tank 22. Components of the receiver-integrated refrigerant condenser 2 including the receiving unit 31 are formed from an aluminum material, and are assembled integrally by brazing.

A super-cooling portion 23*b* is constructed by a lower portion in the core portion 23 of the receiver-integrated refrigerant condenser 2, positioned lower than the first and second separators 28, 29. In the super-cooling portion 23*b* of the core portion 23, liquid refrigerant separated in the receiving unit 31 is super-cooled by performing a heat exchange with outside air.

Figure 2:
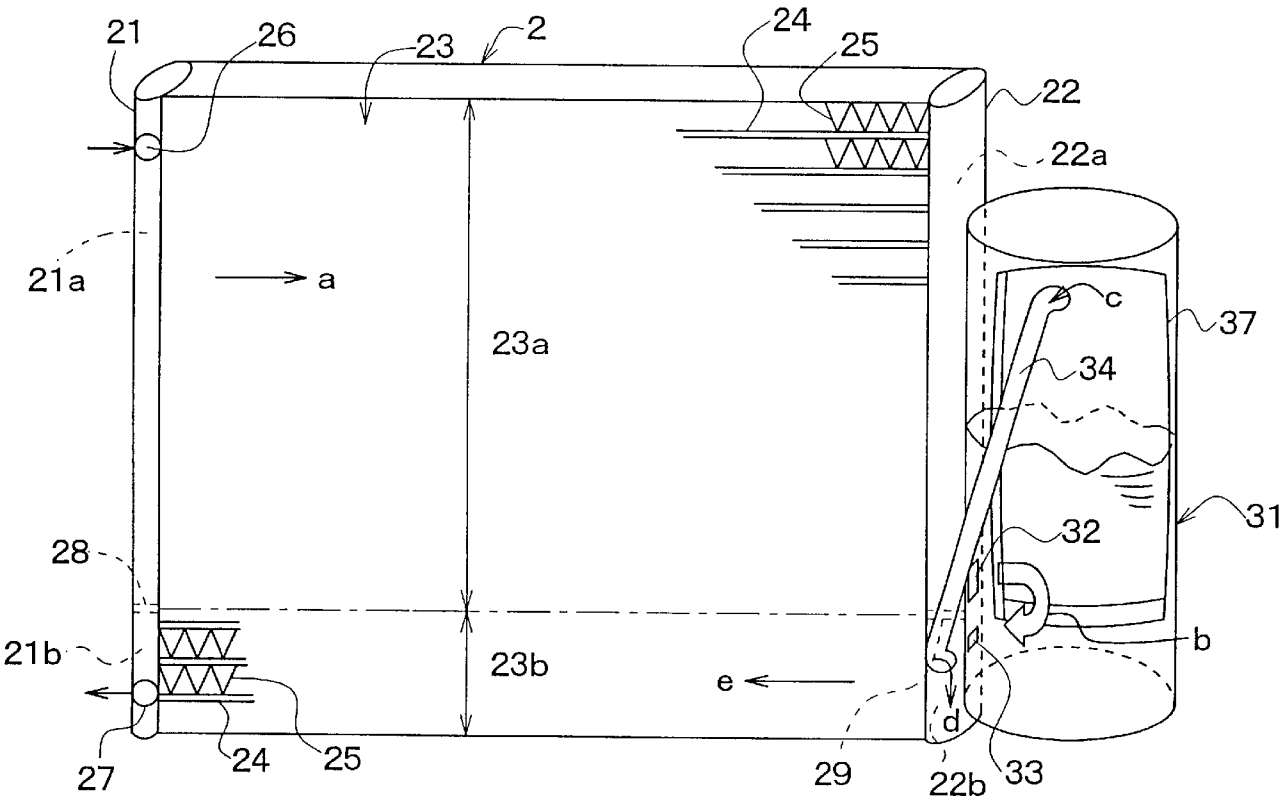
FIG. 2 is a schematic perspective view showing a main portion of a receiver-integrated refrigerant condenser of the refrigerant cycle system according to the first embodiment.

Next, a communication structure communicating between an inner space of the receiving unit 31 and an inner space of the second header tank 22 will be now described. As shown in FIG. 2, a first communication hole 32 (first refrigerant passage) is provided in a wall surface between the second header tank 22 and the receiving unit 31 to penetrate through the wall surface at a position slightly upper than the second separator 29 in the second header tank 22, so that the upper space 22*a* of the second header tank 22 communicates with the receiving unit 31 through the first communication hole 32. A second communication hole 33 (second refrigerant passage) is provided in the wall surface between the second header tank 22 and the receiving unit 31 to penetrate through the wall surface at a position lower than the second separator 29, so that the inner space at a lower side in the receiving unit 31 communicates with the lower space 22*b* in the second header tank 22 through the second communication hole 33.

Each of the first and second communication holes 32, 33 is formed into a rectangular shape, for example. Refrigerant passing through the condensation portion 23*a* of the core portion 23 flows into the lower side space in the receiving unit 31 through the first communication hole 32, and liquid refrigerant stored in the lower side within the receiving unit 31 flows into the lower space 22*b* in the second header tank 22 through the second communication hole 33.

Further, a gas bypass pipe 34 defining a gas bypass passage (third refrigerant passage) is connected between the receiving unit 31 and the second header tank 22. In the first embodiment, gas refrigerant staying in the upper side within the receiving unit 31 can be discharged to a downstream side of the receiving unit 31 from the receiving unit 31 through the gas bypass pipe 34. For example, a thin pipe having an inner diameter of $\phi$2 mm can be used as the gas bypass pipe 34. One end (upper end) of the gas bypass pipe 34 communicates with the upper side space within the receiving unit 31, and the other end (lower end) of the gas bypass pipe 34 communicates with the lower space 22*b* of the second header tank 22 at a position slightly lower than the second separator 29. That is, the other end (outlet portion) of the gas bypass pipe 34 communicates with the lower space 22*b* within the second header tank 22 at a position directly after the second communication hole 33.

For obtaining a gas-refrigerant discharge function using the gas bypass pipe 34, it is necessary to have a predetermined pressure difference between both ends of the gas bypass pipe 34. Specifically, an opening area of the second communication hole 33 is set at an area corresponding to $\phi$3 mm. The opening area of second communication hole 33 is greatly smaller than a pipe sectional area of a high-pressure liquid refrigerant pipe 27*a* (see FIG. 1) connected to the outlet joint 27 of the refrigerant condenser 2. Generally, the inner diameter of the high-pressure liquid refrigerant pipe 27*a* is $\phi$6 mm.

In the first embodiment, the second communication hole 33 is provided to generate a pressure loss therein. Accordingly, the pressure loss is caused in a main flow (shown by the arrow "b") of refrigerant passing through the second communication hole 33. Thus, the second communication hole 33 is used as a pressure generation portion (throttle portion) for generating the pressure loss. Therefore, the pressure at the other end of the gas bypass pipe 34, positioned at a direct downstream side of the second communication hole 33 is decreased as compared with the pressure at the one end (upper end) of the gas bypass pipe 34, opened at a top side within the receiving unit 31. As a result, gas refrigerant in the upper side within the receiving unit 31 can flow into a downstream side of the second communication hole 33 through the gas bypass pipe 34.

It is unnecessary to generate a pressure loss in the first communication hole 32. Therefore, the opening area of the first communication hole 33 can be made sufficiently larger. For example, the opening area of the first communication hole 33 is set at an area corresponding to $\phi$10 mm.

On the other hand, a cylindrical body portion (tank member) of the receiving unit 31 is formed approximately cylindrically by bending and connecting a single plate. A lower end of the cylindrical body portion of the receiving unit 31 is closed by an installation pedestal. 35. The installation pedestal 35 is air-tightly detachably fixed to the body portion of the receiving unit 31 through a seal member by using screwing means. A filter 36 for removing dust contained in refrigerant is integrally formed on an upper side of the installation pedestal 35. The filter 36 is formed by a network structure having a cylindrical shape. A desiccant 37 for absorbing water contained in refrigerant is disposed at an upper side of the filter 36. The desiccant 37 is constructed by a grained desiccant contained in a bag member in which refrigerant can pass.

Liquid refrigerant in the lower side of the receiving unit 31 flows into an inner side of the network filter 36 after contacting the desiccant 37, as shown by the arrow "b" in FIGS. 1 and 2. Thereafter, the liquid refrigerant from the filter 36 passes through the second communication hole 33, and flows into the lower space 22*b* of the second header tank 22.

Accordingly, in the first embodiment of the present invention, the receiver-integrated refrigerant condenser 2 is constructed by the condensation portion 23*a*, the receiving unit 31 and the super-cooling portion 23*b* in this order in the refrigerant flow direction. In a normal refrigerant-sealing state, the gas-liquid interface surface within the receiving unit 31 is placed at an intermediate height position between the first communication hole 32 and a top end surface of the receiving unit 31.

The receiver-integrated refrigerant condenser 2 is disposed at a most front portion within the engine compartment on a front side of a radiator, and both of the refrigerant condenser 2 and the radiator are cooled by a common cooling fan.

Next, operation of the refrigerant cycle system will be described. When operation of the vehicle air conditioner starts and the electromagnetic clutch 1*a* is turned on, rotation power of the engine is transmitted to the compressor 1 so that refrigerant is compressed and discharged by the compressor 1. Thus, super-heating gas refrigerant discharged from the compressor 1 flows into the upper space 21*a* of the first header tank 21 of the refrigerant condenser 2 through the inlet joint 26. Refrigerant in the upper space 21*a* of the first header tank 21 flows into the upper space 22*a* of the second header tank 22 after passing through the upper side tubes 24 in the condensation portion 23*a*. While refrigerant flows through the tubes 24 in the condensation portion 23*a*, refrigerant discharged from the compressor 1 is heat-exchanged with air passing through the condensation portion 23*a* to be cooled. Refrigerant flowing into the upper space 22*a* of the second header tank 22 is a super-cooled liquid refrigerant having some super-cooling degree, or a saturation liquid refrigerant including a part of gas refrigerant. Refrigerant flowing into the upper space 22*a* of the second header tank 22 flows into the lower side within the receiving unit 31 through the first communication hole 32 as shown by the arrow "b" in FIG. 1.

Refrigerant is separated into gas refrigerant and liquid refrigerant in the receiving unit 31, and the liquid refrigerant is stored therein. The liquid refrigerant at the lower side within the receiving unit 31 flows into the lower space 22*b* in the second header tank 22 through the second communication hole 33 as shown by the arrow "b", and further flows through the tubes 24 in the super-cooling portion 23*b* from the lower space 22*b* of the second header tank 22.

In the super-cooling portion 23*b*, the liquid refrigerant is further cooled, and the super-cooled refrigerant is discharged to an outside of the condenser 2 from the outlet joint 27 after passing through the lower space 21*b* of the first header tank 21.

The super-cooled liquid refrigerant passes through the sight glass 3, and flows into the expansion valve 4. The super-cooled refrigerant is decompressed in the expansion valve 4 to becomes in low-temperature low pressure gas-liquid refrigerant. Gas-liquid refrigerant from the expansion valve 4 is heat-exchanged with air in the evaporator 5, so that air passing through the evaporator 5 is cooled by absorbing evaporation latent heat of refrigerant. Superheating gas refrigerant evaporated in the evaporator 5 is sucked into the compressor 1 to be compressed again.

Next, refrigerant sealing performance (refrigerant receiving performance) of the refrigerant cycle system due to the gas bypass pipe 34 will be now described. When the receiver-integrated refrigerant condenser 2 is actually mounted on the vehicle, hot air in the engine compartment, after passing through the condenser 2 and the radiator, can be introduced into a front side of the condenser 2 in a vehicle idling, for example. In this case, heat in the engine compartment is readily transmitted to the receiving unit 31. When the receiving unit 31 receives heat from the hot air in the engine compartment, liquid refrigerant within the receiving unit 31 is boiled, and gas refrigerant pressure in the receiving unit 31 is increased. Therefore, the liquid surface of the liquid refrigerant in the receiving unit 31 may be decreased. However, according to the first embodiment of the present invention, the upper-side gas refrigerant space within the receiving unit 31 communicates with the lower space 22*b* at a downstream side of the second communication hole 33 where the pressure loss is caused, through the gas bypass pipe 34. Therefore, the pressure at the lower end of the gas bypass pipe 34 becomes lower than the pressure at the upper end of the gas bypass pipe 34. Accordingly, gas refrigerant at the upper side in the receiving unit 31 can be discharged into the lower space 22*b* at the downstream side of the second communication hole 33, through the gas bypass pipe 34. Thus, even when the liquid refrigerant within the receiving unit 31 is boiled by receiving heat from the hot air in the engine compartment, it can restrict the gas refrigerant pressure within the receiving unit 31 from being increased. As a result, even when the receiving unit 31 receives heat from an outside, the liquid surface of the liquid refrigerant in the receiving unit 31 is not lowered, and liquid refrigerant can be effectively stored in the receiving unit 31. Further, it can restrict refrigerant over-flowing from the receiving unit 31 toward the condenser 2, thereby preventing an increase of the high-pressure side refrigerant pressure and an increase of power consumed in the compressor 1. Therefore, the performance of cycle (COP) can be improved in the refrigerant cycle system.

The gas refrigerant from the gas bypass pipe 34 is cooled while passing through the tubes 24 in the super-cooling portion 23*b* from the lower space 22*b* in the second header tank 22, and becomes in a super-cooling state.

Figure 3:
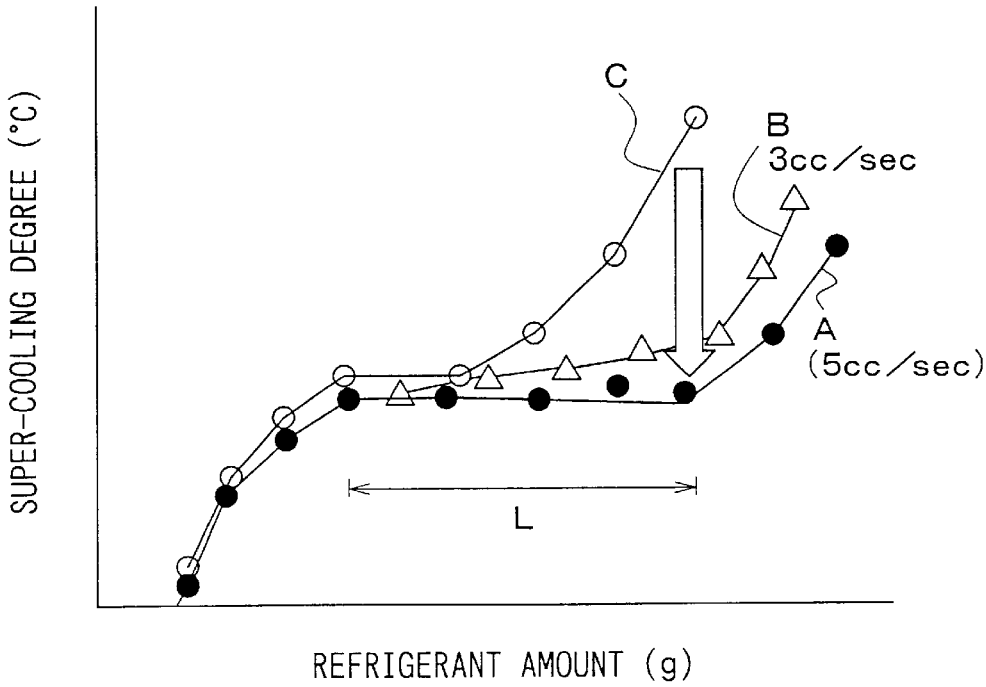
FIG. 3 is a graph showing a relationship between a super-cooling temperature (degree) of refrigerant at an outlet of a super-cooling portion and a refrigerant amount sealed in the refrigerant cycle system, according to the first embodiment.

The inventors of the present invention experimentally produce the condenser 2 (examples A and B) having the gas bypass pipe 34 and a comparison example C without the gas bypass pipe 34, and compare the refrigerant sealing performance, as shown in FIG. 3. FIG. 3 shows a relationship between the super-cooling degree of refrigerant at the outlet of the super-cooling portion 23*b* of the condenser 2 and a refrigerant amount sealed in the refrigerant cycle system, in the examples A, B and C. As a refrigerant sealing condition in FIG. 3, the temperature of cooling air flowing into an inlet of the condenser is set at 35° C., a flow rate of the cooling air flowing into the inlet of the condenser is set at 2.5 m/s, the temperature of air sucked into the evaporator 5 is at 30° C., the humidity of air sucked into the evaporator 5 is 50% RH, and the rotation speed of the compressor 1 is at 1500 rpm. Further, among the examples A and B of the present invention having the gas bypass pipe 34, a flow amount of gas refrigerant flowing through the gas bypass path 34 is set at 5 cc/sec in the example A, and the flow amount of gas refrigerant flowing through the gas bypass path 34 is set at 3 cc/sec in the example B. On the contrary, the example C is a comparison example without having the gas bypass pipe 34.

In the comparison example C without having the gas bypass pipe 34, gas refrigerant at the upper side in the receiving unit 31 cannot be discharged from the receiving unit 31. Therefore, liquid refrigerant cannot be effectively stored at the upper side in the receiving unit 31. Accordingly, when the refrigerant sealing amount is increased in the refrigerant cycle system, the refrigerant amount over-flowing into the super-cooling portion is increased, and the super-cooling degree at the outlet of the super-cooling portion 23*b* is increased, as shown in FIG. 3. As a result, in the comparison example C, the high-pressure side refrigerant pressure is increased, and the COP of the refrigerant cycle system is decreased.

However, in the examples A and B of the present invention, because the gas refrigerant at the upper side in the receiving unit 31 can be discharged to the downstream side of the second communication hole 33, through the gas bypass pipe 34, liquid refrigerant also can be stored at the upper side within the receiving unit 31. Therefore, as shown in FIG. 3, in a predetermined refrigerant-amount range L, the super-cooling degree at the outlet of the super-cooling portion 23*b* can be made approximately constant, and the COP of the refrigerant cycle system can be improved. Further, when the flow amount of refrigerant in the gas bypass pipe 34 is increased as in the example A of the present invention, it can further restrict the super-cooling degree from being increased at the outlet of the super-cooling portion 23*b*. According to experiments by the inventors of the present invention, when the flow amount of gas refrigerant in the gas bypass pipe 34 is set in a range of 3–5 cc/sec, the super-cooling degree at the outlet of the super-cooling portion 23*b* can be effectively restricted.

Figure 4:
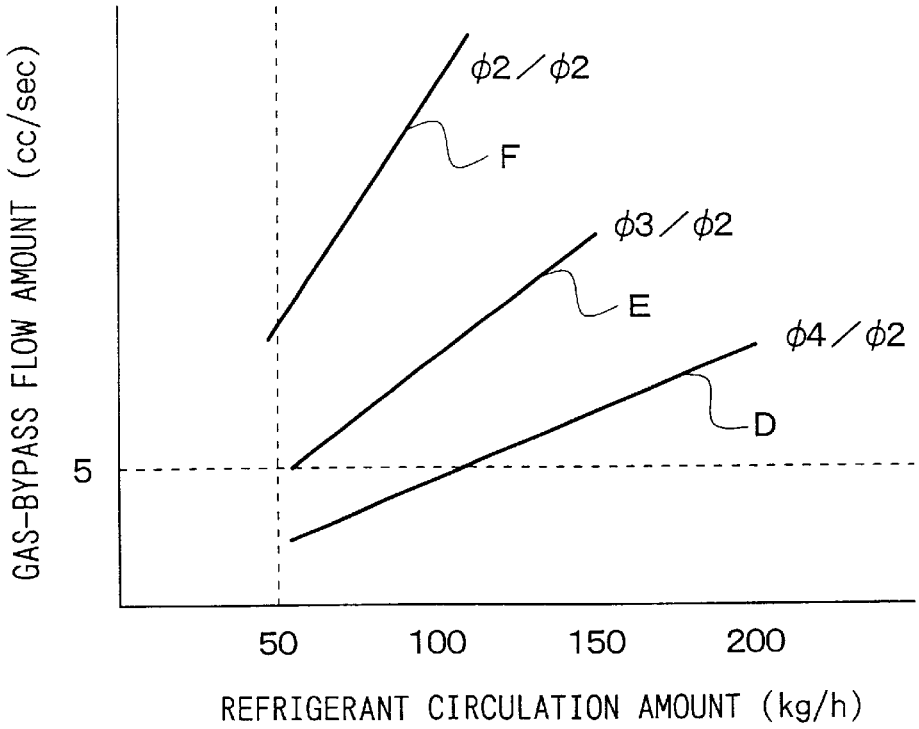
FIG. 4 is a graph obtained by experiments, showing a relationship between a gas-bypass flow amount, a refrigerant amount circulating in the refrigerant cycle system, and a ratio of a hole area of the second communication hole to a gas bypass sectional area, according to the first embodiment.

FIG. 4 shows a relationship between a refrigerant circulation amount in the refrigerant cycle system and a gas-bypass flow amount. In FIG. 4, examples D, E and F show the cases where the opening areas of the second communication holes 33 correspond to areas of $\phi$4 mm, $\phi$3 mm and $\phi$2 mm, respectively. Further, the inner diameter of the gas bypass pipe 34 is set at 2 mm, in each of the examples D, E and F. As shown in FIG. 4, when the opening area of the second communication hole 33 is made smaller, the pressure loss caused in the second communication hole 33 is increased, thereby increasing the pressure difference between both the ends of the gas bypass pipe 34 and increasing the gas bypass flow amount.

Figure 5:
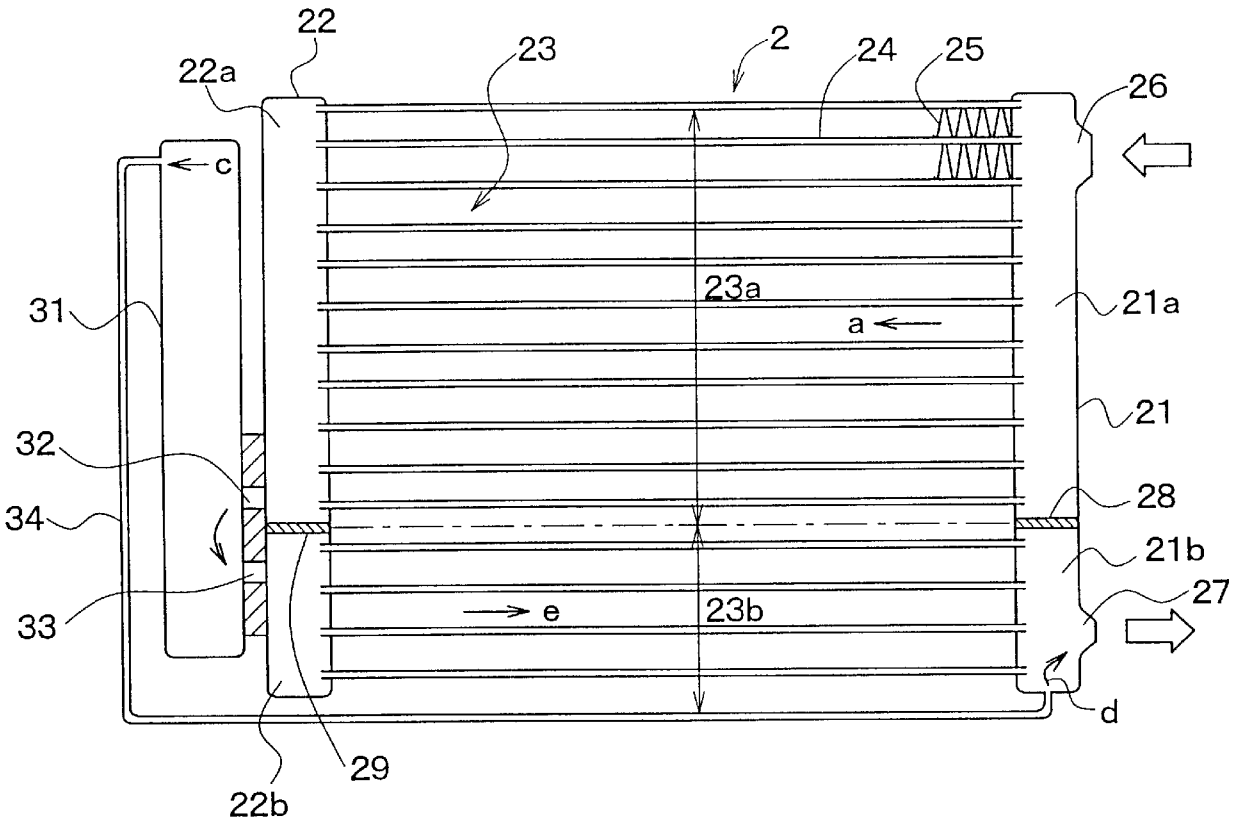
FIG. 5 is a schematic sectional view showing a main portion of a receiver-integrated refrigerant condenser of a refrigerant cycle system according to a second preferred embodiment of the present invention.

A second preferred embodiment of the present invention will be now described with reference to FIG. 5. In the above-described first embodiment of the present invention, the outlet of the gas bypass pipe 34 communicates with the lower space 22*b* of the second header tank 22 of the condenser 2. However, in the second embodiment, as shown in FIG. 5, the outlet of the gas bypass pipe 34 is provided to communicate with the lower space 21*b* of the first header tank 21.

According to the second embodiment of the present invention, because the pressure difference is generated between both the ends of the gas bypass pipe 34 due to the pressure loss in the super-cooling portion 23*b*, it is unnecessary for the second communication hole 33 to be used as the pressure-loss generation portion. Accordingly, the opening area of the second communication hole 33 can be freely set.

In the second embodiment, because the super-cooling portion 23*b* is used as the pressure-loss generation portion, the outlet end of the gas bypass pipe 34 can be connected to the high-pressure liquid refrigerant pipe 27*a* (see FIG. 1). Alternatively, the outlet end of the gas bypass pipe 34 can be connected to a low-pressure side refrigerant passage (e.g., a downstream side of the expansion valve 4), through a suitable throttle.

A third preferred embodiment of the present invention will be now described with reference to FIGS. 6A and 6B. In the above-described first and second embodiments of the present invention, the gas bypass pipe 34 joined from an outside of the receiving unit 31 is used as a gas-refrigerant discharge unit for discharging the gas refrigerant at the upper side in the receiving unit 31 to an outside of the receiving unit 31. However, in the third embodiment, the gas-refrigerant discharge unit is constructed by using a connection plate 40 that is used for temporally fixing the receiving unit 31 and the second header tank 22.

Figure 6B:
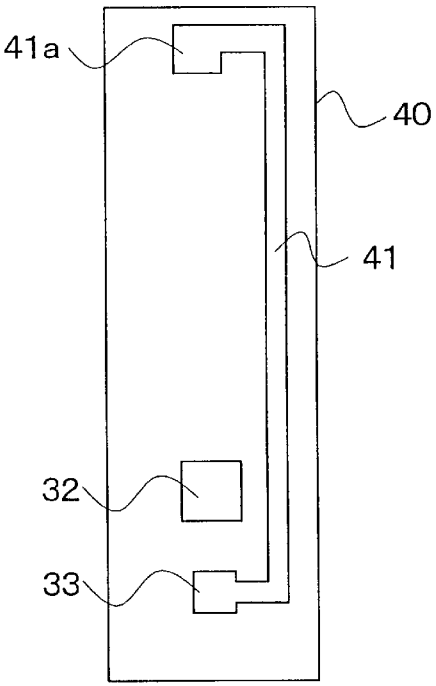
FIG. 6A is a sectional view and FIG. 6B is a front view, each showing a main portion of a receiver-integrated refrigerant condenser of a refrigerant cycle system according to a third preferred embodiment of the present invention.
Figure 6A:
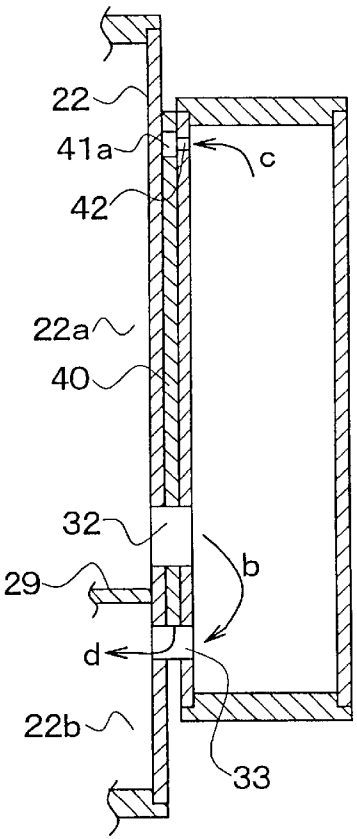

As shown in FIGS. 6A and 6B, in the third embodiment of the present invention, the connection plate 40 is inserted between the receiving unit 31 and the second header tank 22, to be connected to the receiving unit 31 and the second header tank 22 by a fastening member. Therefore, in an assembling step before a brazing of the receiver-integrated refrigerant condenser 2, the connection plate 40 is used for temporally fixing the receiving unit 31 and the second header tank 22.

As shown in FIG. 6B, the connection plate 40 is made of an aluminum alloy, and is formed into an elongated rectangular shape by pressing. In the pressing, the first communication hole 32 and the second communication hole 33 are opened in the connection plate 40, and a gas bypass passage 41 (third refrigerant passage) extending in a longitudinal direction (i.e., vertical direction) of the connection plate 40 is provided in the connection plate 40. A lower end portion of the gas bypass passage 41 is bent by a right angle to communicate with the second hole 33. Further, an upper end of the gas bypass passage 41 is bent by a right angle to form a gas-refrigerant inlet portion 41*a*. The gas bypass passage 41 is formed in the connection plate 40 by punching a plate surface of the connection plate 40.

On the other hand, a gas-refrigerant introduction hole 42 is opened in a wall surface of the receiving unit 31, contacting the connection plate 40, at an upper end side. The connection plate 40 and the receiving unit 3 are temporally fixed so that the gas-refrigerant introduction hole 42 communicates with the gas-refrigerant inlet portion 41*a* of the connection plate 40. After the brazing of the receiver-integrated refrigerant condenser 2 is finished, both front and back surfaces of the connection plate 40 are bonded to a flat surface of the receiving unit 31 and a flat surface of second header tank 22. The gas bypass passage 41 is defined between the flat surface of the receiving unit 31 and the flat surface of the second header tank 22.

According to the third embodiment of the present invention, the gas refrigerant at the upper side in the receiving unit 31 flows into the gas-refrigerant inlet portion 41*a* of the connection plate 40 from the gas-refrigerant introduction hole 42, and flows through the gas bypass passage 41 downwardly. Thereafter, the has refrigerant in the gas bypass passage 41 flows into the lower space 22*b* of the second header tank 22 through the second communication hole 33 from the lower end portion (outlet portion) of the gas bypass passage 41.

In the third embodiment, the gas bypass passage 41 corresponding to the gas bypass pipe 34 of the first embodiment is constructed using the connection plate 40 for temporally fixing the receiving unit 31 and the second header tank 22 of the receiver-integrated refrigerant condenser 2. Accordingly, the gas-refrigerant discharge unit for discharging the gas refrigerant in the receiving unit 31 can be manufactured in low cost. In the third embodiment, other portions are similar to those of the above-described first embodiment. Therefore, in the third embodiment, the same advantage described in the first embodiment can be obtained.

Figure 7B:
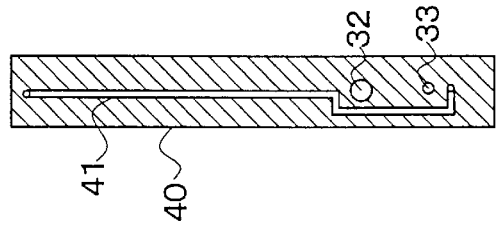
FIG. 7B is a cross-sectional view taken along line VIIB—VIIB in FIG. 7A.
Figure 7A:
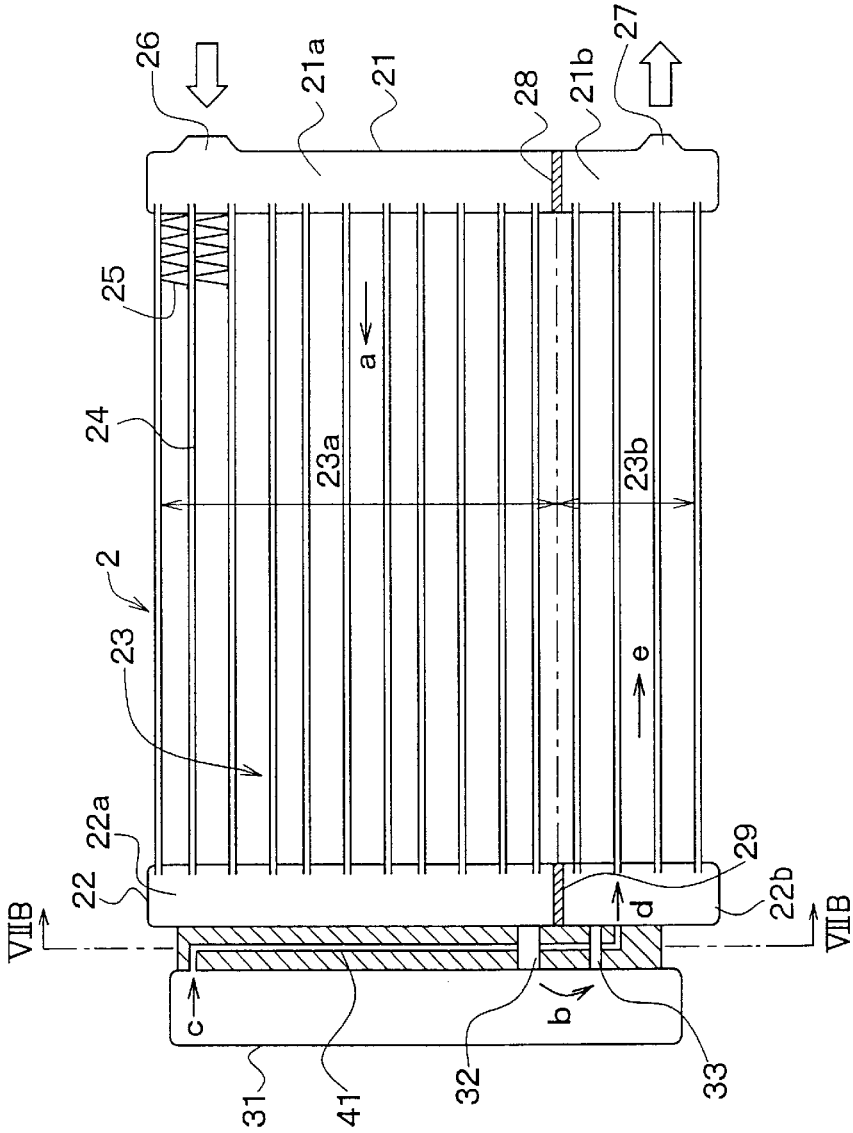
FIG. 7A is a schematic sectional view showing a receiver-integrated refrigerant condenser of a refrigerant cycle system according to a fourth preferred embodiment of the present invention.

A fourth preferred embodiment of the present invention will be now described with reference to FIGS. 7A and 7B. In the above-described third embodiment of the present invention, the lower end portion of the gas bypass passage 41 of the connection pipe 40 is directly communicated with the second communication hole 33. However, in the fourth embodiment of the present invention, as shown in FIGS. 7A and 7B, the lower end portion (outlet portion) of the gas-refrigerant bypass passage 41 of the connection plate 40 is communicated with the lower space 22*b* of the second header tank 22 around the second communication hole 33. That is, the lower end portion (outlet portion) of the gas-refrigerant bypass passage 41 of the connection plate 40 is communicated with the lower space 22*b* of the second header tank 22 at a downstream side of the second communication hole 33 in the refrigerant flow direction. Even in this case, the advantage described in the first embodiment can be obtained.

Figure 8B:
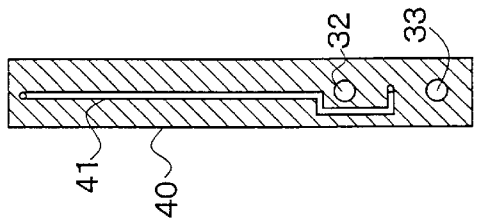
FIG. 8B is a cross-sectional view taken along line VIIIB—VIIIB in FIG. 8A.
Figure 8A:
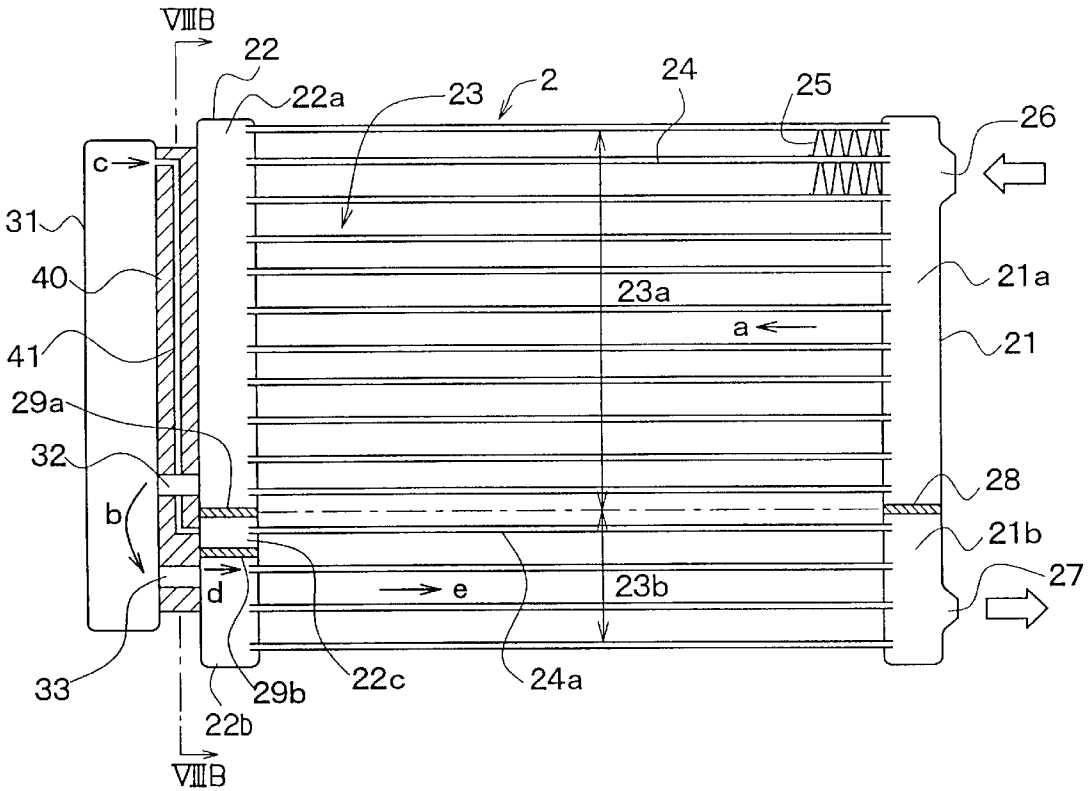
FIG. 8A is a schematic sectional view showing a receiver-integrated refrigerant condenser of a refrigerant cycle system according to a fifth preferred embodiment of the present invention.

A fifth preferred embodiment of the present invention will be now described with reference to FIGS. 8A and 8B. In the fifth embodiment, two second separators 29*a*, 29*b* are provided in the second header tank 22 to have a predetermined distance therebetween in the up-down direction. A bypass chamber 22*c* is provided in the second header tank 22 between the two separators 29*a* and 29*b*, and the lower end portion (outlet portion) of the gas bypass passage 41 of the connection plate 40 communicates with the bypass chamber 22*c*. Further, the bypass chamber 22*c* is provided to communicate the lower space 21*b* of the first header tank 21 through the bypass tube 24*a* disposed between the condensation portion 23*a* and the super-cooling portion 23*b* in the core portion 23.

According to the fifth embodiment of the present invention, a gas bypass path corresponding to the gas bypass pipe 34 described in the second embodiment is constructed by the gas bypass passage 41 of the connection plate 40, the bypass chamber 22*c* and the bypass tube 24*a*. Accordingly, similarly to the above-described second embodiment of the present invention, the second communication hole 33 can be formed to not generate the pressure loss. That is, the area of the second communication hole 33 can be arbitrarily changed.

In the fifth embodiment of the present invention, the bypass tube 24*a* can be formed into the same shape as the other tubes 24. Alternatively, in the fifth embodiment, a passage sectional area of the bypass tube 24*a* can be formed larger than the other tubes 24. In this case, the gas bypass amount through the bypass tube 24*a* can be increased.

Figure 9B:
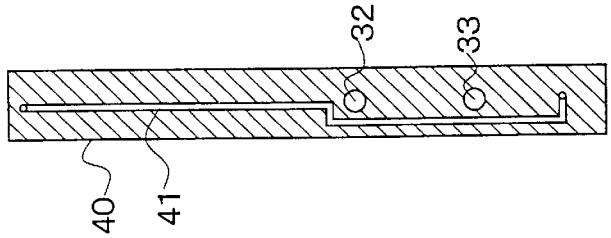
FIG. 9B is a cross-sectional view taken along line IXB—IXB in FIG. 9A.
Figure 9A:
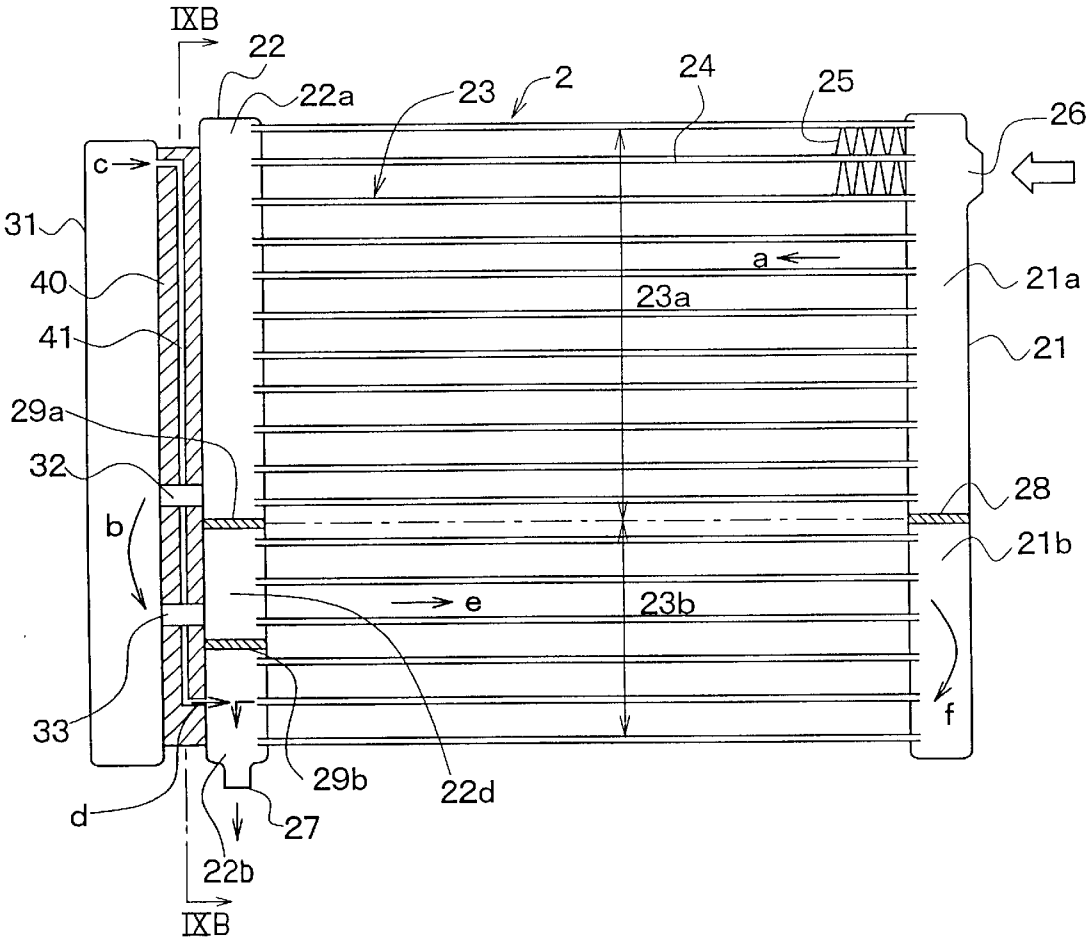
FIG. 9A is a schematic sectional view showing a receiver-integrated refrigerant condenser of a refrigerant cycle system according to the sixth preferred embodiment of the present invention.

A sixth preferred embodiment of the present invention will be now described with reference to FIGS. 9A and 9B. In the sixth embodiment, the two second separators 29*a*, 29*b* are disposed in the second header tank 22 so that the inner space of the second header tank 22 is separated into an upper space 22*a*, a middle space 22*d* and a lower space 22*b*, in the up-down direction of the second header tank 22.

Further, the second communication hole 33 is communicated with the middle space 22*d* of the second header tank 22, so that the liquid refrigerant at the lower side in the receiving unit 31 flows into the middle space 22*d*, and passes through the tubes 24 at the upper side in the super-cooling portion 23*b*. Further, in the sixth embodiment, the outlet joint 27 is provided to communicate with the lower space 22*b* in the second header tank 22. Accordingly, liquid refrigerant at the lower side in the receiving unit 31 passes through the second communication hole 33, passes through the tubes 24 at the upper portion in the super-cooling portion 23*b*, and flows into the lower space 21*b* of the first header tank 21 to be U-turned in the lower space 21*b* of the first header tank 21 as shown by the arrow "f" in FIG. 9A. Thereafter, the liquid refrigerant, after being U-turned in the lower space 21*b* of the first header tank 21, passes through the tubes 24 at the lower side portion in the super-cooling portion, and flows into the lower space 22*b* of the second header tank 22 to be discharged from the outlet joint 27.

On the other hand, the lower end portion (outlet portion) of the gas bypass passage 41 formed in the connection plate 40 communicates with the lower space 22*b* within the second header tank 22. Therefore, the gas refrigerant at the upper side in the receiving unit 31 is discharged into the lower space 22*b* in the second header tank 22 through the gas bypass passage 41.

According to the sixth embodiment of the present invention, the pressure difference can be caused between both the ends of the gas bypass passage 41 by the pressure loss in the U-turn passage in the super-cooling portion 23*b*. Therefore, it is unnecessary to form the pressure loss function in the second communication hole 33.

Figure 10B:
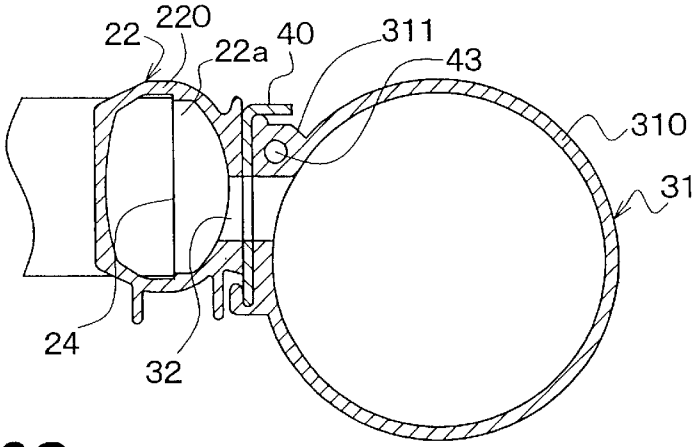
FIG. 10B is a cross-sectional view taken along line XB—XB in FIG. 10A.
Figure 10C:
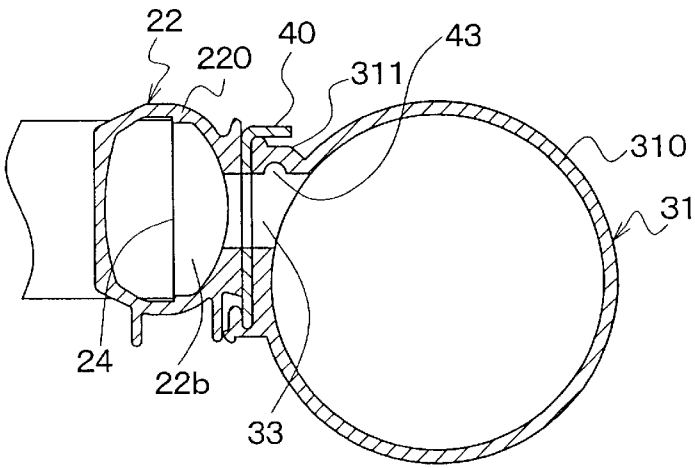
FIG. 10C is a cross-sectional view taken along line XC—XC in FIG. 10A.
Figure 10A:
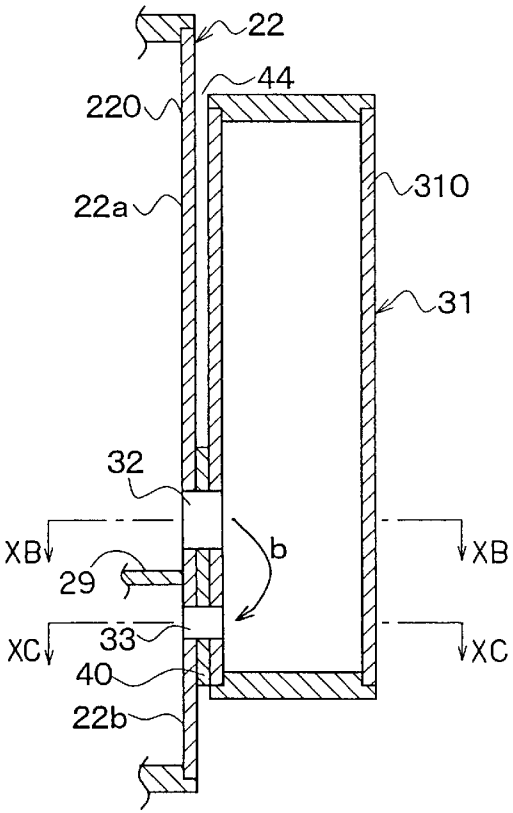
FIG. 10A is a sectional view showing a main portion of a receiver-integrated condenser according to a seventh preferred embodiment of the present invention.

A seventh preferred embodiment of the present invention will be now described with reference to FIGS. 10A–10C. In the seventh embodiment, a cylindrical body portion 220 of the second header tank 22 is integrally formed by punching or drawing, using a metal material such as an aluminum alloy. Similarly, a cylindrical body portion 310 of the receiving unit 31 is integrally formed by the punching or the drawing, using a metal material such as an aluminum alloy. While the cylindrical body portion 310 of the receiving unit 31 is integrally formed by the punching or the drawing, the gas bypass passage 43 is formed in the cylindrical body portion 310 at the same time.

Specifically, a protrusion portion 311 protruding to an outside of the receiving unit 31 is formed at a side of the second header tank 22 (i.e., at a side of the connection plate 40) in the cylindrical body portion 310 of the receiving unit 31, to extend in the up-down direction. A circular hole extending in the up-down direction is opened in the protrusion portion 311 to form the gas bypass passage 43.

While the cylindrical body portion 310 is formed, both the upper and lower ends of the gas bypass passage 43 are opened to outside. Therefore, the openings of both the upper and lower ends of the gas bypass passage 43 are closed by using a suitable closing manner such as a sealing of a brazing material. Further, a communication hole (not shown) is opened in the cylindrical body portion 310, so that a top portion of the gas bypass passage 43 communicates with the inner side of the receiving unit 31, at a position around a top end within the receiving unit 31.

The second communication hole 33, through which liquid refrigerant within the receiving unit 31 flows into the lower space 22*b* of the second header tank 22, is used as the pressure loss generation portion. Further, the opening positions of the second communication hole 33 and the gas bypass passage 43 are set so that the second communication hole 33 is directly crossed with the gas bypass passage 43. Accordingly, the lower end portion of the gas bypass passage 43 communicates with the second communication hole 33 where the pressure loss is generated.

According to the seventh embodiment of the present invention, because the gas bypass passage 43 is formed at the same time while the cylindrical body portion 310 of the receiving unit 31 is integrally formed, the receiver-integrated refrigerant condenser can be manufactured in low cost. Therefore, it is unnecessary to form the gas bypass passage 43 in the connection plate 40 for temporally fixing the receiving unit 31 and the second header tank 22. Accordingly, a dimension of the connection plate 40 in the up-down direction can be made greatly smaller as compared with a case where the gas bypass passage 41 is provided in the connection plate 40. That is, the dimension of the connection plate 40 can be set so that the connection plate 40 contacts the receiving unit 31 and the second header tank 22 of the receiver-integrated refrigerant condenser 2, only in the area around the first and second communication holes 33. Thus, a clearance 44 can be formed between the receiving unit 31 and the second header tank 22 of the receiver-integrated refrigerant condenser 2, and it can effectively restrict a heat transmission from the second header tank 22 to the receiving unit 31.

In the seventh embodiment of the present invention, because the gas bypass passage 43 is provided so that gas refrigerant in the receiving unit 31 is discharged outside of the receiving unit 31, the same effect described in the first embodiment can be obtained.

An eighth preferred embodiment of the present invention will be now described with reference to FIGS. 11A and 11B. In the eighth embodiment of the present invention, a throttle portion 36*a* for generating a pressure loss is formed in the filter 36, and the outlet portion of the gas bypass pipe 34 is provided to communicate with the downstream side of the throttle portion 36*a*. Specifically, a cylindrical member 312 is connected integrally into a lower inside portion of the cylindrical body portion 310 of the receiving unit 31, and the installation pedestal 35 of the filter 36 is detachably fixed to the cylindrical member 312 by a screw member to be air-tightly attached to the cylindrical member 312 through a seal member. The filter 36 constructed by a cylindrical network member is disposed on the installation pedestal 35, and the desiccant 37 for removing water contained in the refrigerant is disposed on the filter 36. The desiccant 37 is constructed by a grained desiccant contained in a bag member, so that the refrigerant can pass through the desiccant 37.

The filter 36 has a circular cover member 36*b* at its top end. An outer peripheral portion of the cover member 36 tightly contacts an inner peripheral surface of the cylindrical member 312, so that an inner space of the receiving unit 31 can be partitioned into upper and lower spaces by the cover member 36*b*. Further, a throttle portion 36*a* composed of a small round hole is formed in the cover member 36*b*.

Figure 11B:
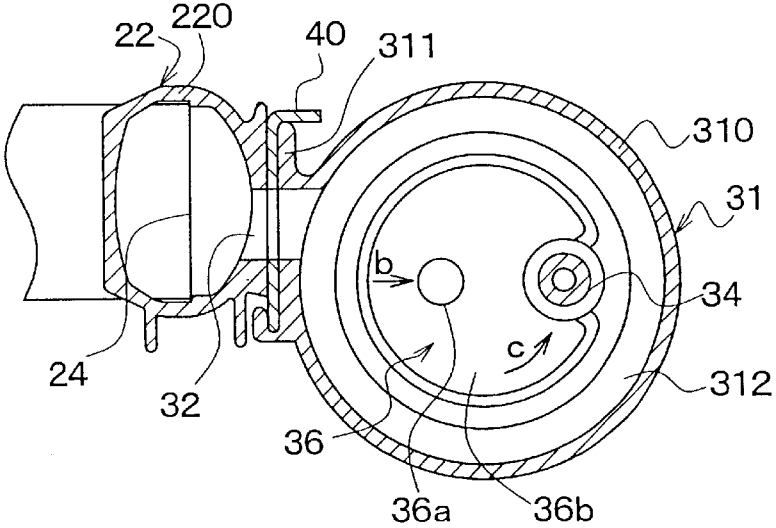
FIG. 11A is a vertical sectional view and FIG. 11B is a transverse sectional view, each showing a main structure of a receiver-integrated refrigerant condenser, according to an eighth preferred embodiment of the present invention.
Figure 11A:
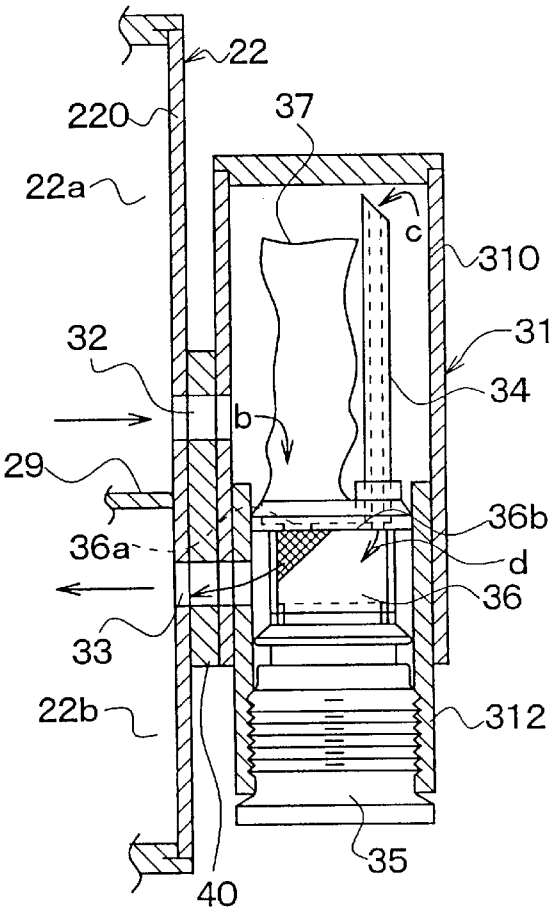

An opening area of the throttle portion 36*a* is set to be smaller than the opening area of the first and second communication holes 32, 33, so that a pressure loss due to the throttle portion 36*a* is caused relative to a main flow of refrigerant shown by the arrow "b" in FIGS. 11A and 11B. The liquid refrigerant condensed in the condensation portion 23*a* flows from the upper space 22*a* of the second header tank 22 into the upper space of the receiving unit 31 upper than the cover member 36*b*, through the first communication hole 32. Thereafter, the refrigerant in the upper space of the receiving unit 31 passes through the throttle portion 36*a* and the second communication hole 33, and flows into the lower space 22*b* of the second header tank 22. Therefore, the pressure loss is generated in the throttle portion 36*a* relative to the main refrigerant flow shown by the arrow "b". Accordingly, in the eighth embodiment, the opening area of the second communication hole 33 can be set to be equal to that of the first communication hole 32.

On the other hand, the lower end of the gas bypass pipe 34 is fixed to the cover member 36*b* of the filter 36, so that the outlet portion of the gas bypass pipe 34 communicates with a downstream side of the throttle portion 36. Here, the downstream side of the throttle portion 36*a* is positioned under the cover member 36*b* inside the filter 36 composed of the cylindrical network. Thus, the outlet portion (bottom opening end) of the gas bypass pipe 34 communicates with the lower space of the cover member 36*b* after penetrating through the cover member 36*b*. The inlet portion (top opening end) of the gas bypass, pipe 34 is opened in the upper space of the receiving unit 31 at a position around the top end of the receiving unit 31.

According to the eighth embodiment of the present invention, the refrigerant flowing from the lower space 22*b* of the second header tank 22 into the lower space of the receiving unit 31 is throttled in the throttle portion 36*a* to generate the pressure loss. Therefore, the pressure at the downstream side of the throttle portion 36*a* is lower than the pressure in the upper space of the receiving unit 31. That is, the pressure at the outlet portion of the gas bypass pipe 34 is lower than the pressure at the inlet portion of the gas bypass pipe 34. Accordingly, the gas refrigerant in the upper space within the receiving unit 31 can be effectively discharged to the downstream side of the throttle portion 36*a* through the gas bypass pipe 34.

According to the eighth embodiment of the present invention, the gas-refrigerant discharge unit for discharging the gas refrigerant in the upper space of the receiving unit 31 is constructed only in the receiving unit 31 by effectively using the filter 36. Therefore, the gas-refrigerant discharge function can be readily obtained in the receiving unit 31 by only changing the structure of the receiving unit 31, without changing the other parts in an original receiver-integrated refrigerant condenser 2.

In the eighth embodiment of the present invention, the outlet portion of the gas bypass pipe 34 can be directly communicated to the throttle portion in the cover member 36*b*.

Although the present invention has been fully described in connection with the preferred embodiments thereof with reference to the accompanying drawings, it is to be noted that various changes and modifications will become apparent to those skilled in the art.

For example, in the above-described first embodiment of the present invention, the receiving unit 31 is integrated with the second header tank 22 where the inlet joint 26 and the outlet joint 27 are not provided. However, the receiving unit 31 can be integrated with the first header tank 21 where the inlet joint 26 and the outlet joint 27 are provided. Further, the receiving unit 31 and any one of the first and second header tanks 21, 22 can be communicated through a suitable pipe member.

In the above-described embodiments, the present invention is applied to the receiver-integrated refrigerant condenser 2 where the core portion 23 is constructed by the condensation portion 23*a* and the super-cooling portion 23*b* which are integrated with each other. However, the present invention can be applied to a condenser where the core portion 23 is constructed only by the condensation portion 23*a*, and the super-cooling portion 23*b* is formed separately from the condensation portion 23*a*. In this case, the outlet joint 27 is not provided in the first header tank 21, but is provided in the receiving unit 31, so that the liquid refrigerant from the outlet joint flows into the super-cooling portion. Further, the present invention can be applied to a refrigerant cycle system without having the super-cooling portion 23*b*.

In the above-described embodiments, the present invention is typically applied to the refrigerant cycle system having the receive-integrated refrigerant condenser 2. However, the present invention can be applied to a refrigerant cycle system where the receiver is separated from the condenser.

Such changes and modifications are to be understood as being within the scope of the present invention as defined by the appended claims.

What is claimed is:

1. A refrigerant cycle system comprising:

a compressor for compressing refrigerant;

a condenser having a condensation portion for cooling and condensing refrigerant discharged from the compressor; and a receiver for separating refrigerant from the condensation portion of the condenser into gas refrigerant and liquid refrigerant, and for storing the liquid refrigerant therein, wherein:

the condenser and the receiver are disposed to have a first refrigerant passage through which refrigerant after passing through the condensation portion flows into the receiver, a second refrigerant passage through which liquid refrigerant stored at a lower side in the receiver flows outside the receiver, and a third refrigerant passage having two end portions with a pressure difference, through which gas refrigerant staying at an upper side in the receiver is discharged to a downstream side of the receiver.

2. The refrigerant cycle system according to claim 1, wherein:

the condenser includes a core portion at least including the condensation portion, having plurality of tubes through which refrigerant flows, and a header tank extending in the up-down direction to communicate with the tubes;

the receiver is integrated with the header tank; and each of the first and second refrigerant passages is a communication hole penetrating through the header tank and the receiver.

3. The refrigerant cycle system according to claim 1, wherein the third refrigerant passage is defined by a gas bypass pipe connected to the receiver from an outside of the receiver.

4. The refrigerant cycle system according to claim 2, further comprising a connection plate member inserted between the header tank and the receiver, wherein the third refrigerant passage is provided in the connection plate member.

5. The refrigerant cycle system according to claim 1, wherein:

the receiver includes an approximately cylindrical body portion integrally formed by one of punching and drawing; and the third refrigerant passage is provided in the body portion while the body portion is integrally formed.

6. The refrigerant cycle system according to claim 1, wherein:

the second refrigerant passage is provided to generate a pressure loss therein;

the third refrigerant passage has an outlet from which the gas refrigerant introduced in the third refrigerant passage is discharged; and the outlet of the third refrigerant passage is provided in the second refrigerant passage.

7. The refrigerant cycle system according to claim 1, wherein:

the second refrigerant passage is provided to generate a pressure loss therein;

the third refrigerant passage has an outlet from which the gas refrigerant introduced in the third refrigerant passage is discharged; and the outlet of the third refrigerant passage is provided at a downstream side of the second refrigerant passage.

8. The refrigerant cycle system according to claim 1, wherein:

core portion of the condenser further includes a super-cooling portion in which liquid refrigerant from the second refrigerant passage is super-cooled;

the third refrigerant passage has an outlet from which the gas refrigerant introduced in the third refrigerant passage is discharged; and the outlet of the third refrigerant passage is provided at a downstream side of the super-cooling portion.

9. The refrigerant cycle system according to claim 8, wherein:

the super-cooling portion has a refrigerant path having a refrigerant inlet and a refrigerant outlet, through which refrigerant meanderingly flows; and both the refrigerant inlet and the refrigerant outlet of the super-cooling portion are disposed adjacent to the receiver.

10. The refrigerant cycle system according to claim 1, further comprising:

a filter for removing dust contained in the refrigerant, the filter being disposed in the receiver such that refrigerant from the first refrigerant passage flows toward the second refrigerant passage after passing through the filter, wherein:

the filter has a partition member for partitioning an inner space of the receiver into a first space communicating with the first refrigerant passage and a second space communicating with the second refrigerant passage;

the partition member has a throttle portion for generating a pressure loss; and the third refrigerant passage has an outlet from which gas refrigerant introduced in the third refrigerant passage is discharged, in the receiving unit.

11. The refrigerant cycle system according to claim 10, wherein the outlet of the third refrigerant passage is provided at a downstream side of the throttle portion.

12. The refrigerant cycle system according to claim 10, wherein the outlet of the third refrigerant passage is provided in the throttle portion of the partition member.

13. The refrigerant cycle system according to claim 10, wherein:

the filter includes a cylindrical network portion for filtering refrigerant, and a cover member for covering an upstream end of the cylindrical network portion; and the partition member is the cover member of the filter.

14. The refrigerant cycle system according to claim 1, wherein the second refrigerant passage is provided to generate the predetermined pressure difference at the two end portions of the third refrigerant passage.

15. The refrigerant cycle system according to claim 1, wherein:

the condenser further includes a super-cooling portion for super-cooling liquid refrigerant from the receiver, a first header tank having an inlet port from which refrigerant discharged from the compressor is introduced, and a second header tank integrated with the receiver; and the condensation portion and the super-cooling portion are disposed between the first header tank and the second header tank.

16. The refrigerant cycle system according to claim 15, wherein:

the second header tank has therein a partition member for partitioning an inner space of the second header tank into a first space communicating with the condensation portion and a second space communicating with the super-cooling portion;

the first refrigerant passage is a first communication hole through which the first space of the second header tank communicates with the receiver; and the second refrigerant passage is a second communication hole through which the second space of the second header tank communicates with the receiver at a position lower than the first communication hole.

17. The refrigerant cycle system according to claim 16, wherein:

the second communication hole has an opening area smaller than a predetermined area to generate a pressure loss therein; and the third refrigerant passage is defined by a pipe member having an inlet opened at an upper side adjacent to a top end in the receiver, and an outlet opened at a downstream side of the second communication hole in a flow direction of refrigerant flowing through the second communication hole.

18. The refrigerant cycle system according to claim 16, wherein:

the third refrigerant passage is defined by a pipe member having an inlet opened at an upper side adjacent to a top end in the receiver, and an outlet opened into the first header tank at a downstream side of the super-cooling portion.

19. The refrigerant cycle system according to claim 16, further comprising:

a connection plate member inserted between the second header tank and the receiver, wherein:

the second communication hole has an opening area smaller than a predetermined area to generate a pressure loss therein; and the third refrigerant passage is provided in the connection plate member to have an inlet opened at an upper side adjacent to a top end in the receiver, and an outlet opened into the second header tank at a downstream side of the second communication hole.

20. A refrigerant cycle system comprising:

a compressor for compressing refrigerant;

a condenser having a condensation portion for cooling and condensing refrigerant discharged from the compressor;

a receiver for separating refrigerant from the condensation portion of the condenser into gas refrigerant and liquid refrigerant, and for storing the liquid refrigerant therein;

first means for forming a first refrigerant passage through which refrigerant after passing through the condensation portion flows into the receiver;

second means for forming a second refrigerant passage through which liquid refrigerant stored at a lower side in the receiver flows outside the receiver; and third means for forming a third refrigerant passage through which gas refrigerant staying at an upper side in the receiver is discharged to a downstream side of the receiver, wherein the third refrigerant passage has a pressure difference larger than a predetermined amount, at two end portions of the third refrigerant passage.

* * * * *